US006698960B2

(12) United States Patent
Noguchi

(10) Patent No.: US 6,698,960 B2
(45) Date of Patent: Mar. 2, 2004

(54) PUSH-BUTTON WRITING IMPLEMENT

(75) Inventor: Kaoru Noguchi, Saitama-Ken (JP)

(73) Assignee: Kotobuki & Co., Ltd., Kyoto (JP)

( * ) Notice: Subject to any disclaimer, the term of this patent is extended or adjusted under 35 U.S.C. 154(b) by 28 days.

(21) Appl. No.: 10/235,634

(22) Filed: Sep. 6, 2002

(65) Prior Publication Data

US 2003/0210945 A1 Nov. 13, 2003

(30) Foreign Application Priority Data

May 7, 2002 (JP) ..... 2002-131287

(51) Int. Cl.[7] ..... B43K 29/00; B43K 5/16

(52) U.S. Cl. ..... 401/195; 401/192; 401/111; 401/112

(58) Field of Search ..... 401/195, 192, 401/109, 110, 111, 112, 113

(56) References Cited

U.S. PATENT DOCUMENTS 5,735,592 A * 4/1998 Shu ..... 362/118

5,988,915 A * 11/1999 Magill ..... 401/52

* cited by examiner

*Primary Examiner*—David J. Walczak

(74) *Attorney, Agent, or Firm*—Rothwell, Figg, Ernst & Manbeck

(57) ABSTRACT

A push-button writing implement includes a barrel having at least a transparent or semitransparent part, a refill axially slidably contained in the barrel, and provided with a writing tip, and a refill-operating mechanism including a push button, and a return spring and designed so as to be operated by the push button to project the writing tip of the refill from a tip of the barrel and to retract the same into the barrel. A front stopper ring having the shape of an O ring is put on the refill, a fancy member is axially slidably put on part of the refill extending backward beyond the front stopper ring, and the fancy member is moved up and down along the refill when the refill is moved by resilience of the return spring by operating the refill-operating mechanism.

9 Claims, 7 Drawing Sheets

PUSH-BUTTON WRITING IMPLEMENT

BACKGROUND OF THE INVENTION

1. Field of the Invention

The present invention relates to a push-button writing implement, such as a mechanical pencil or a ballpoint pen, having an added value for amusement.

2. Description of the Related Art

Conventional push-button writing implements of this kind include, other than those having writing functions, those having a barrel printed with well-known character, and those having a decorated barrel. A printed character printed on the side surface of a barrel is planar, is capable of adding a value of the publicity of the character, is incapable of giving strong impression and is erasable.

A prior art push-button writing implement disclosed in JP-A No. 278483/1998 has a barrel provided with an ornamental article attached to its outer surface. This ornamental article is an obstacle to using the push-button writing implement and to carrying the same in a pocket.

SUMMARY OF THE INVENTION

Accordingly, it is an object of the present invention to provide a fancy push-button writing implement having functions required of push-button writing implements, positively using the function of a return spring, having an added value for a toy or amusement, and capable of being used for writing and being carried without difficulty.

According to one aspect of the present invention, a push-button writing implement includes: a barrel having at least a transparent or semitransparent part; a refill axially slidably contained in the barrel, and provided with a writing tip; and a refill-operating mechanism including a push-button and a return spring, and designed so as to be operated by the push-button to project the writing tip of the refill from a tip of the barrel and to retract the same into the barrel; wherein a front stopper ring having the shape of an O ring is put on the refill, a fancy member is axially slidably put on part of the refill extending backward beyond the front stopper ring, and the fancy member is moved up and down along the refill when the refill is moved by the resilience of the return spring by operating the refill-operating mechanism.

According to another aspect of the present invention, a push-button writing implement includes: a barrel having at least a transparent or semitransparent part; a refill axially slidably contained in the barrel, and provided with a writing tip; and a refill-operating mechanism including a push button, and a return spring and designed so as to be operated by the push button to project the writing tip of the refill from a tip of the barrel and to retract the same into the barrel; wherein a fancy member is fixedly put on the refill, and the fancy member is moved together with the refill when the refill is moved by the resilience of the return spring by operating the refill-operating mechanism.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
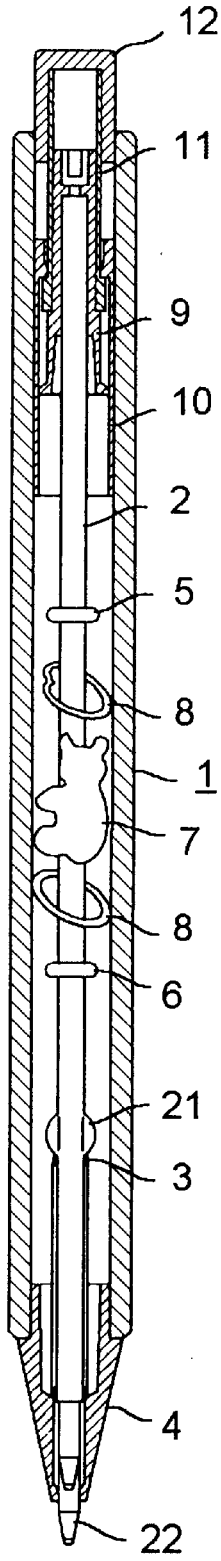
FIG. 1 is a longitudinal sectional view of a push-button ballpoint pen in a first embodiment according to the present invention.
Figure 2:
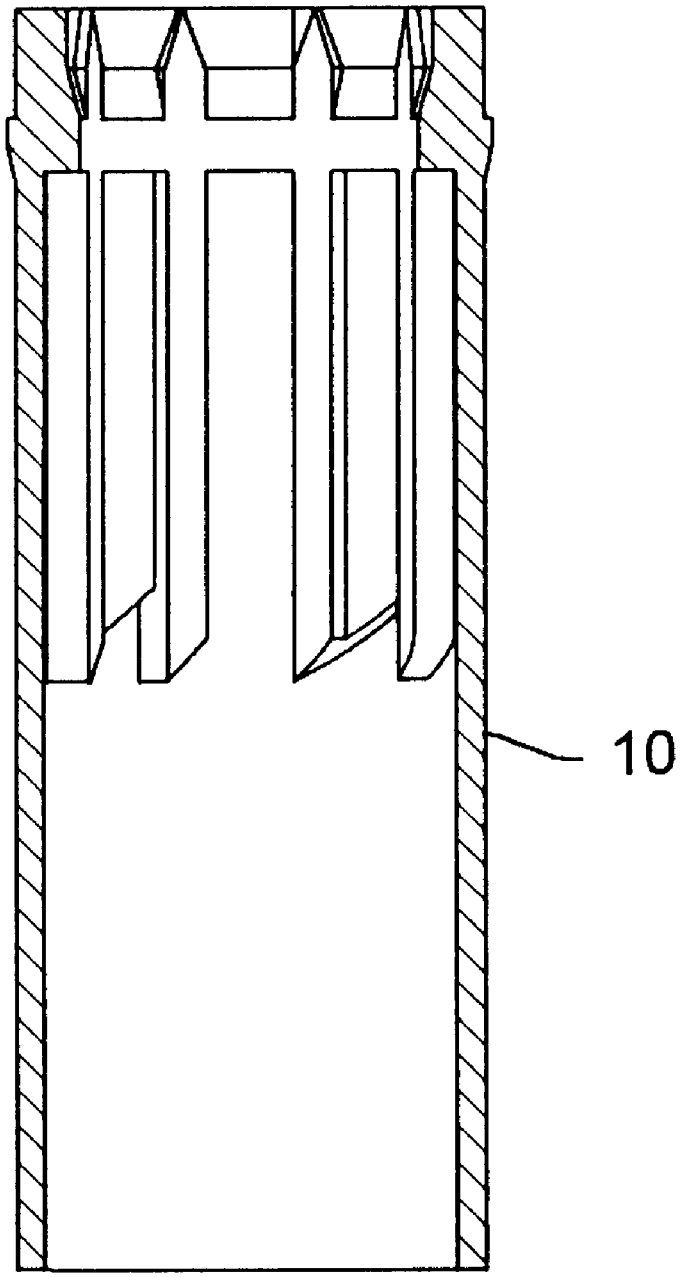
FIG. 2 is an enlarged, longitudinal sectional view of a main cam included in the push-button ballpoint pen shown in FIG. 1.

Referring to FIGS. 1 and 2, a push-button ballpoint pen in a first embodiment according to the present invention has a barrel 1 having a transparent or semitransparent part, a ballpoint refill (hereinafter referred to simply as "refill") 2 axially slidably contained in the barrel 1 and provided with a ballpoint tip 22, i.e., a writing tip, and a refill-operating mechanism for operating the refill 2. The refill 2 is provided with a protrusion 21 resting on the back end of a return spring 3. A barrel cap 4 is attached to the front end of the barrel 1. The return spring 3 is extended between the barrel cap 4 and the protrusion 21 of the refill 2. An elastic back stopper 5 having the shape of an O ring, and an elastic front stopper 6 having the shape of an O ring are put on a part of the refill extending behind the protrusion 21. The stoppers 5 and 6 are spaced a predetermined distance apart. A bear doll 7, i.e., a fancy member, and two rings 8, i.e., decorative parts, are axially movably put on a part between the stoppers 5 and 6 of the refill 2. The bear doll 7 and the rings 8 may be of any suitable shapes provided that the bear doll 7 and the rings 8 can be axially slidably put on the refill 2. For example, the rings 8 may have a shape resembling a star.

A back end part of the refill 2 is fitted in a rotary cam 9 having a working part engaged with a stationary cam 10 (FIG. 2) fixedly fitted in the barrel 1. A push tube 11 is inserted in the barrel so as to lie between the rotary cam 9 and the stationary cam 10, and to be in contact with the rotary cam 9. A push button 12 is put on the back end of the push tube 11.

When using the push-button ballpoint pen, the push button 12 is pushed to advance the push cam 11. Consequently, the rotary cam 9 in contact with the push tube 11 and engaged with the stationary cam 10 turns relative to the stationary cam 10, and the refill 2 is advanced against the resilience of the return spring 3. Thus, the ballpoint tip 22 of the refill 2 is projected from the tip of the barrel cap 4. When the push button 12 is fully depressed, the rotary cam 9 is restrained from axial movement by the stationary cam 10 to keep the ballpoint tip 22 projected from the barrel cap 4 for writing. When retracting the ballpoint tip 22 into the barrel 1, the push button 12 is depressed again. Then, the rotary cam 9 is turned and is disengaged from the stationary cam 10. Then, the rotary cam 9 is moved backward by the resilience of the return spring 3 and, consequently, the ballpoint tip 22 of the refill 2 is retracted into the barrel 1.

When the push button 12 is depressed, the front end of the rotary cam 9 moves along the cam profile of the stationary cam 10 and the rotary cam 9 moves intermittently. On the other hand, the refill 2 moves to a position near the front end of its stroke when the push button 12 is depressed, and the refill 2 is moved slightly backward by the resilience of the return spring 3 upon completion of the operation for depressing the push button 12. When the refill 2 is thus moved backward, the bear doll 7 and the rings 8 are thrust backward by the front stopper 6. The bear doll 7 and the rings 8 jump backward, strike against the back stopper 5, and bounce off the back stopper 5 or are gravitated. Since the bear doll 7 and the rings 8 are contained in the transparent or semitransparent part of the barrel 1, the backward and forward movement of the bear doll 7 and the rings 8 can be easily seen, which gives amusement to the user. Since the stoppers 5 and 6 are elastic rings, the range of movement of the bear doll 7 and the rings 8 can be adjusted by shifting either the front stopper 6 or the back stopper 5. It is desirable to determine the interval between the stoppers 5 and 6 taking into consideration the resilience of the return spring 3 so that the bear doll 7 is able to strike against the back stopper 5.

Figure 3:
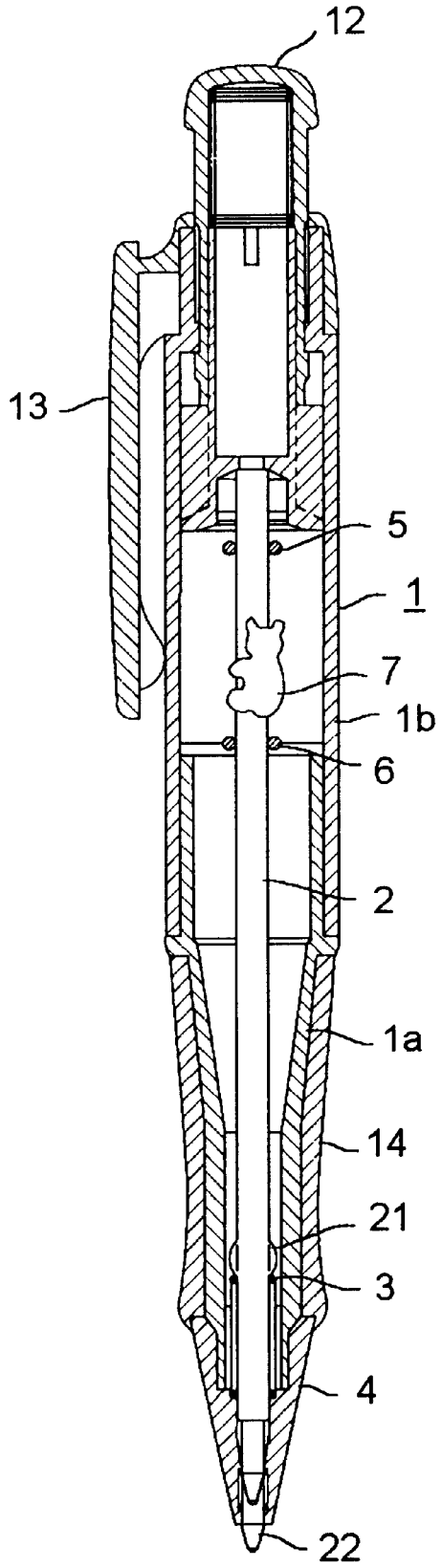
FIG. 3 is a longitudinal sectional view of a push-button ballpoint pen in a second embodiment according to the present invention.

Referring to FIG. 3, a push-button ballpoint pen in a second embodiment according to the present invention has a barrel 1 consisting of a front barrel 1*a* and a back barrel 1*b*, a refill 2 contained in the barrel 1, a clip 13 attached to the back end of the barrel 1, a push button 12, and a grip cover 14 put on the front barrel 1*a*. Only the back barrel 1*b* may be transparent or semitransparent, and the front barrel 1*a* may be opaque. A back stopper 5, a front stopper 6 and a doll 7 are fixedly put on the refill 2. When the push button 12 is depressed, the refill 2 moves axially together with the doll 7. The movement of the doll 7 can be seen through the barrel 1 for amusement. The stoppers 5 and 6 may be omitted.

Figure 4:
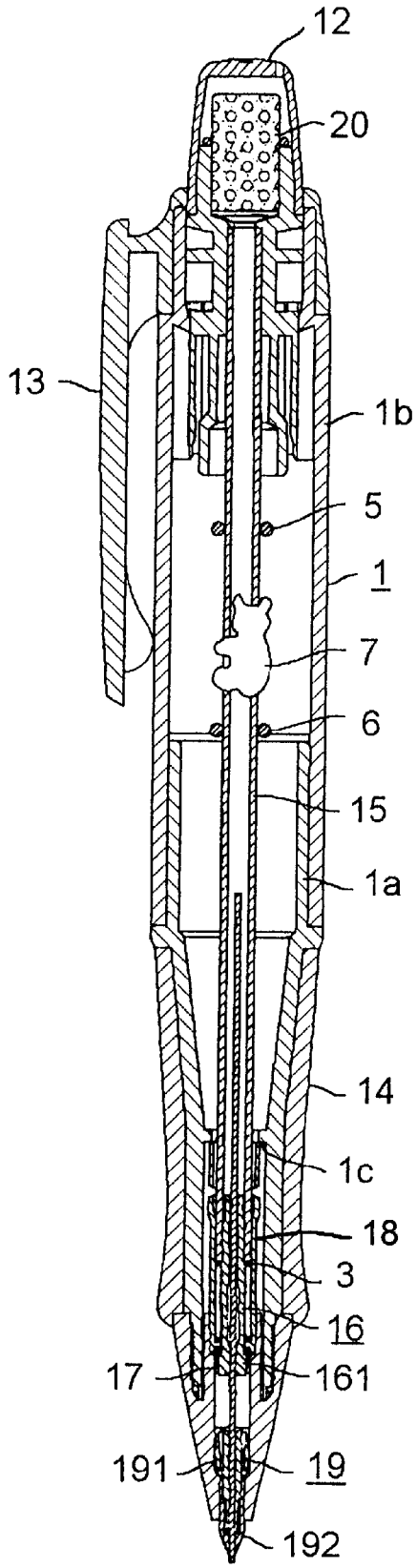
FIG. 4 is a longitudinal sectional view of a push-button ballpoint pen in a third embodiment according to the present invention.

Referring to FIG. 4, a push-button mechanical pencil in a third embodiment according to the present invention has a barrel 1, a lead tank 15 containing leads, i.e., thin marking sticks, and axially slidably contained in the barrel, a chuck 16 pressed in and held on a front part of the lead tank 15 and having a chucking head 161 and a chuck ring 17 put on the chucking head 161, and a cushion sleeve 18 surrounding the lead tank 15 to absorb excessive pressure put on the push-button mechanical pencil when writing. The cushion sleeve 18 is positioned in the barrel 1 with its back end resting on an annular ridge 1*c* formed on the inner surface of the barrel 1. A return spring 3 is extended between the front end of the lead tank 15 and a step formed in the cushion sleeve 18.

A slider 19 provided with a tip 192 is axially slidably fitted in a barrel cap 4 attached to the front end of the barrel 1. The slider 19 has a back sliding part 191 in contact with the front barrel 1*a*. The slider 19 holds a lead so that the lead may not falloff. An elastic back stopper 5 similar to an O ring, and an elastic front stopper 6 similar to an O ring are put on the lead tank 15, and a doll 7, i.e., fancy member, is put axially movably on a part between the stoppers 5 and 6 of the lead barrel 15. When the push button 12 is depressed, the lead tank 15 is caused to move intermittently by the return spring 3, so that the doll 7 shakes on the lead barrel 15. In FIG. 4, indicated at 20 is an eraser.

When using the push-button mechanical pencil, the push button 12 is depressed to advance the lead tank 15 and the chuck 16 against the resilience of the return spring 3. The chuck ring 17 is disengaged from the chucking head 161 while the chuck 16 is thus advanced, and the chuck 16 opens to release the lead. When the force applied to the push button 12 is removed, the lead tank 15 and the chuck 16 are retracted by the resilience of the return spring 3. The chuck 16 is closed to grip the lead while the lead tank 15 is being retracted, and the lead is thus held for writing. When it is desired to retract the lead into the barrel 1, the push button 12 is depressed again to open the chuck 16, so that the lead is released. Then, the lead can be easily retracted into the barrel 1 by pushing the same with a fingertip.

When the push button 12 is thus depressed, the resilience of the return spring 3 exerts shocks on the lead tank 15 and, consequently, the doll 7 is forced to move between the elastic stoppers 5 and 6. Since the barrel 1 has the transparent or semitransparent part, the movement of the doll 7 can be seen through the barrel 1 for amusement. The user is able to enjoy the axial movement of the doll 7 independent of writing by repeatedly depressing the push button 12.

Figure 5:
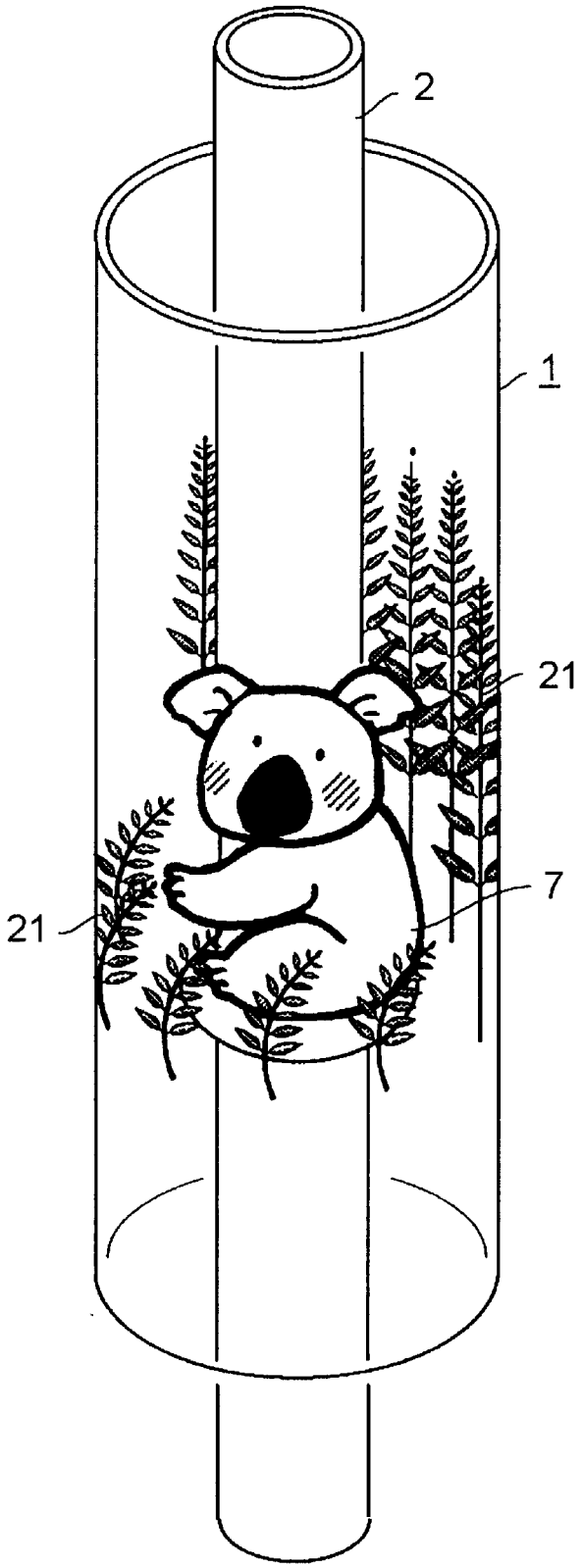
FIG. 5 is an enlarged perspective view of an essential part of a push-button ballpoint pen in a fourth embodiment according to the present invention.
Figure 6:
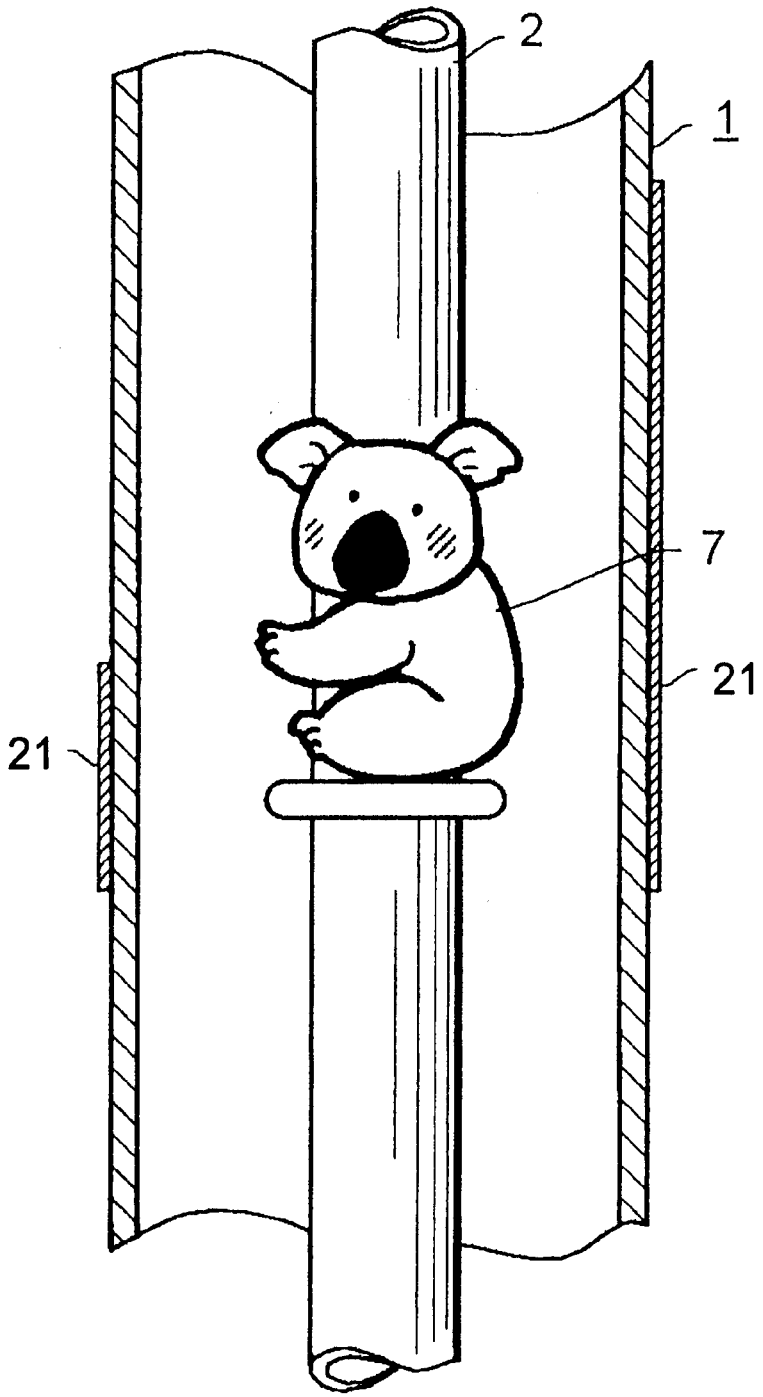
FIG. 6 is a fragmentary, longitudinal sectional view of the push-button ballpoint pen shown in FIG. 5.

Referring to FIGS. 5 and 6 showing an essential part of a push-button mechanical pencil in a fourth embodiment according to the present invention, which is substantially the same in construction as the push-button mechanical pencil in the third embodiment, a panda doll 7 is put on a refill 2 for axial movement and is seated on a front stopper 6. A transparent film 21 printed with a picture of branches of a eucalyptus, i.e., panda's favorite food, is applied to the outer surface of a barrel 1 as shown in FIG. 6. The panda doll 7, similarly to the bear dolls 7 of the foregoing embodiments, is thrust up by the front stopper 6. The picture of branches of a eucalyptus printed on the transparent film 21 enhances the stereoscopic appearance of the panda doll 7.

Figure 7:
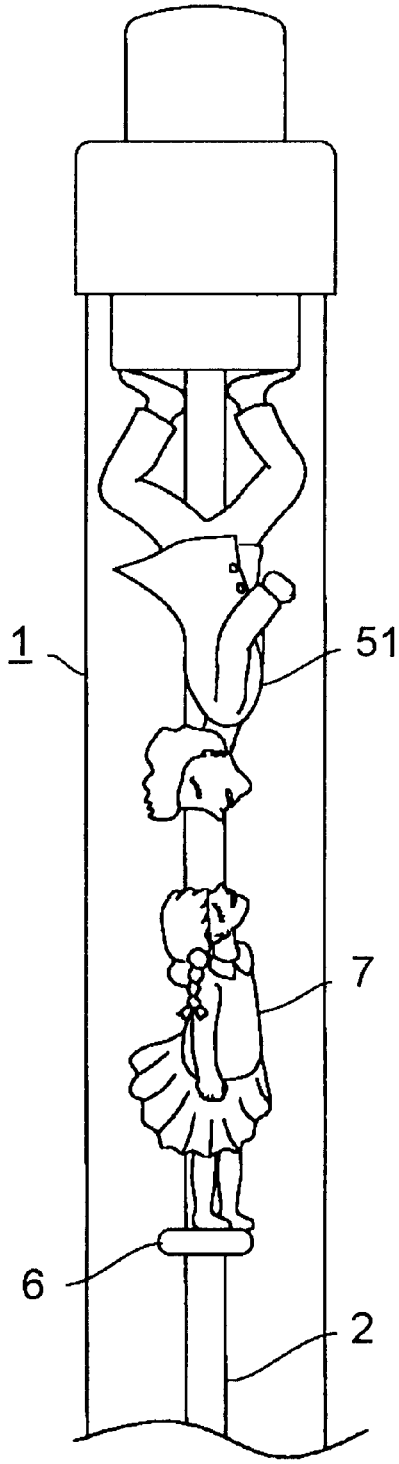
FIG. 7 is an enlarged, fragmentary front elevation of a push-button ballpoint pen in a fifth embodiment according to the present invention.
Figure 8:
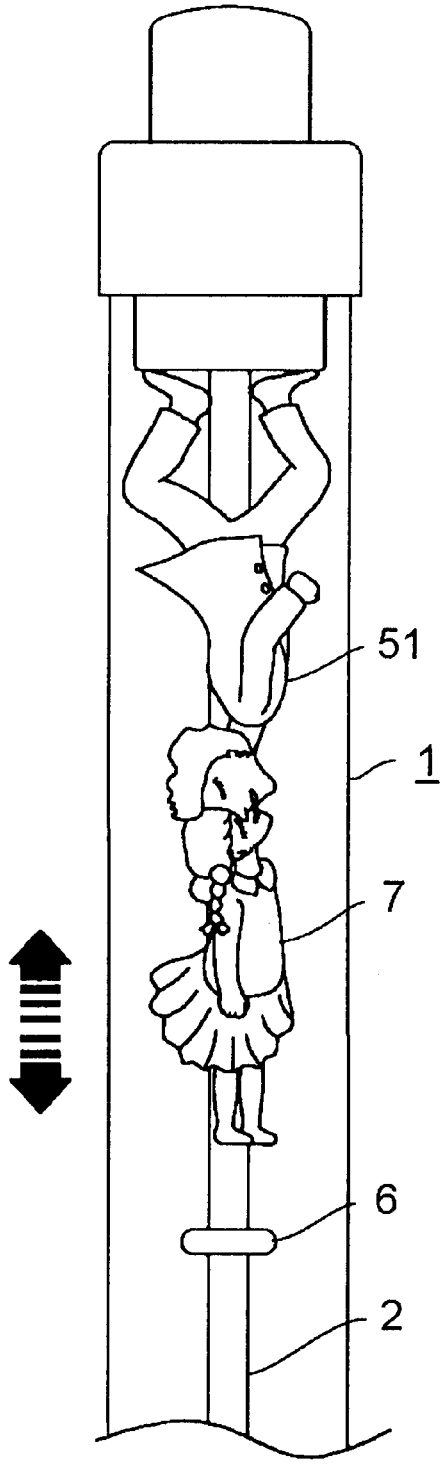
FIG. 8 is an enlarged front elevation of an essential part of the push-button ballpoint pen shown in FIG. 7.

Referring to FIG. 7 showing an essential part of a push-button mechanical pencil in a fifth embodiment according to the present invention, which is substantially the same in construction as the push-button mechanical pencil in the third embodiment, a girl doll 7 is axially movably put on a lead tank so as to rest on a front stopper 6 with its head on the back side, and a boy doll 51 serving also as a back stopper is fixed to the lead tank with its head on the front side. When a push button is depressed, the girl doll 7 jumps up, and the face of the girl doll 7 comes into contact with that of the boy doll 51 as if the girl doll 7 and the boy doll 51 are kissing. Thus, the user is able to enjoy a comical action of the dolls 7 and 51.

The push-button writing implement of the present invention may be provided with any fancy thing other than the doll 7; the push-button writing implement may be provided with a fancy member that generates sound when shocked, such as a bell, or a fancy member that reflects light and glitters, such as a golden or silvery reflector instead of the doll 7.

As apparent from the foregoing description, the push-button writing implement according to the present invention has, in addition to a writing function as that of conventional push-button writing implements, a recreational function as an added value. The solid fancy member put on the refill and contained in the barrel has a remarkable decorative, amusing effect and does not cause troubles in using the push-button writing implement for writing and carrying the same.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A push-button writing implement comprising;

a barrel having at least a transparent or semitransparent part;

a refill axially slidably contained in the barrel, and provided with a writing tip; and a refill-operating mechanism including a push button, and a return spring and designed so as to be operated by the push button to project the writing tip of the refill from a tip of the barrel and to retract the same into the barrel;

wherein a front stopper ring having the shape of an O ring is put on the refill, a fancy member is axially slidably put on part of the refill extending backward beyond the front stopper ring, and the fancy member is moved up and down along the refill when the refill is moved by resilience of the return spring by operating the refill-operating mechanism.

2. The push-button writing implement according to claim 1 further comprising a back stopper put on the refill at a distance from the front stopper;

wherein at least either the front or the back stopper can be moved axially on the refill to adjust the distance between the front and the back stopper.

3. The push-button writing implement according to claim 1, wherein the fancy member generates sound when the fancy member slides along the refill or strikes against the front or the back stopper.

4. The push-button writing implement according to claim 1, wherein the fancy member is a reflecting member capable of reflecting light as the same slides along the refill.

5. The push-button writing implement according to claim 1, wherein the fancy member consists of a plurality of parts, which are loosely fitted to the refill.

6. The push-button writing implement according to claim 1, wherein the fancy member includes either a doll as a main part or decorative parts or includes both the doll and the decorative parts, and the decorative parts are round or star-shaped rings.

7. The push-button writing implement according to claim 1, wherein the refill is a ballpoint refill containing ink and having a front part provided with a protrusion on which a back end of the return spring is held.

8. The push-button writing implement according to claim 1, wherein the refill is a lead tank containing leads and having a chuck means at its front end.

9. The push-button writing implement according to claim 1, wherein pattern picture connected with the fancy member is marked on an outer surface of the barrel surrounding the fancy member to enhance the stereoscopic appearance of the fancy member.

* * * * *